United States Patent [19]

Cianflone

[11] Patent Number: 4,899,050

[45] Date of Patent: Feb. 6, 1990

[54] CEILING FAN CONTROL WAND

[76] Inventor: Robert A. Cianflone, 885 Lovingston Dr., Pittsburgh, Pa. 15216

[21] Appl. No.: 295,504

[22] Filed: Jan. 11, 1989

[51] Int. Cl.[4] ..... H01H 3/20

[52] U.S. Cl. ..... 200/331; 416/5; 81/488; 7/901

[58] Field of Search ..... 200/330, 331; 362/147, 362/404, 457; 416/5; 81/15.9, 488; 7/901; 294/18, 19.11, 26; 211/117, 105.3, 175, 207; 248/295.1, 298; 403/80, 104, 109

[56] References Cited

U.S. PATENT DOCUMENTS

| | | | |
|---|---|---|---|
| 275,042 | 4/1883 | Heysinger | 200/331 |
| 573,835 | 12/1896 | Taylor | 211/175 |
| 970,299 | 9/1910 | Boyd | 248/298 |
| 1,249,716 | 12/1917 | Calder | 248/295.1 |
| 2,812,442 | 11/1957 | DeMun | 362/457 |
| 4,524,646 | 6/1985 | Kimberlin, Jr. | 7/901 |
| 4,633,740 | 1/1987 | Jacobs | 7/901 |
| 4,683,783 | 8/1987 | Fanberg | 81/15.9 |

*Primary Examiner*—Renee S. Luebke
*Assistant Examiner*—Glenn T. Barrett
*Attorney, Agent, or Firm*—Webb, Burden, Ziesenheim & Webb

[57] ABSTRACT

A control wand for use in connection with a ceiling fan for grasping the pull chain and for movement of the motor directional control button thereon. The control wand includes an elongated rod-shaped body with an integral handle formed at one end. The end has a right angle bent portion with a hook-shaped element formed at an end region thereof. The spacing between the hook element and the right angle bent portion is sufficiently large to permit the pull chain to fit therein, but sufficiently small to prevent the passage of an enlarged end of the pull chain to pass therethrough when the wand engages the pull chain and is pulled in a downward direction. The right angle bent portion at the second end of the control wand presents flat upper and lower edges which provide engagement surfaces for moving the directional control button upwardly and downwardly.

6 Claims, 1 Drawing Sheet

CEILING FAN CONTROL WAND

BACKGROUND OF THE INVENTION

The present invention relates generally to ceiling fans of the type having a pull chain for motor and/or light control and, more particularly, to an elongated wand for grasping the pull chain and also for manipulating the directional control switch located on the fan housing.

Commonly used ceiling mounted paddle fans have one or more pull chains extending downwardly from the housing thereof for activating and deactivating the fan motor and light fixture (if so equipped) and also for incrementally controlling the rotative speed of the fan. The motor housing also usually has a slide switch mounted on its side which is used to change the direction of fan rotation. Due to the height of most ceiling fans, it is sometimes necessary to either use a stool or chair to reach the pull chain and directional slide switch or to affix an extension to the end of the pull chain so that it can be reached from a normal standing position. Of course, the use of an extension on the pull chain does not aid in reaching the slide switch on the fan housing. One must still use a stool, chair, or like expedient to gain access to it. The slide switch generally has an activation button which is slidable in a vertical direction and this orientation is particularly difficult to move downwardly unless the person stands on a stool or the like. Use of the aforementioned extension on the pull chain is generally not desired since it is somewhat unsightly and presents a nuisance if it is too long. Use of stools or chairs to reach the standard length pull chains is also not desirable since it presents a danger of slips and falls and is particularly problematic for the elderly who simply cannot use such stools due to their limited mobility and dexterity.

The present invention overcomes these problems by providing a control wand for ceiling fans which permits the user to manipulate the pull chain without the need for any chain extensions, chairs, stools or the like. The present invention further provides a control wand which also is uniquely configured to permit the user to move the slide switch while standing on the floor without the need for any riser or the like.

SUMMARY OF THE INVENTION

Briefly, the present invention comprises an elongated, rod-shaped body having a grasping portion or handle at a first end and a right angle, bent portion at a second end. The right angle bent portion has a terminal end region bent back upon itself forming a hook-shaped element having an open space therein. The hook-shaped element and right angle bent portion preferably lie in a common plane which is perpendicular to a longitudinal axis of the rod-shaped body. The handle on the control wand is adapted to be grasped by the user and the rod shaped body is directed toward the fan whereby the device provides a reach extender to permit the hook-shaped element to pass around the enlarged end of the pull chain of the fan. The open space of the hook-shaped element is sized to permit passage of the beaded chain links therein but to block the movement of the enlarged end of the chain therethrough. An interference fit between the hook-shaped element and the enlarged chain end thus permits the user to pull the chain downwardly by simply moving the control wand in a downward motion. The chain is released by simply raising the wand slightly to remove the tension in the chain and moving the hook element away from the enlarged chain end. The right angle bent portion at the second end of the rod-shaped body presents a convenient shape for manipulating the slide switch of the fan motor in order to change the rotative direction thereof. An upper edge surface of the right angle bent portion is adapted to engage a lower edge of the slide switch button when the button is to be moved upwardly. Conversely, a lower edge surface of the right angle bent portion is adapted to engage an upper edge of the slide switch button when the switch button is to be moved downwardly.

In a slightly modified form, the hook-shaped element is formed in a V-shape, whereby, an apex of the V is suitable for gaining a purchase on the pull chain between the ball-shaped beads thereof.

The handle portion at the first end of the elongated rod-shaped body is preferably integrally formed as a loop-shaped segment bent back upon itself. The handle may be fitted with a magnetic plate to permit the wand to be conveniently attached to a metal surface such as a refrigerator side, for example.

The invention, in a modified form, also comprises two side-by-side, elongated rod-shaped body elements mounted for slidable extensible and retractive movement relative to one another. A pair of resilient sleeve bushings join the two body elements together to permit the relative extension of the elements whereby a greater reach distance is achieved by the wand.

DETAILED DESCRIPTION OF THE INVENTION

Figure 1:
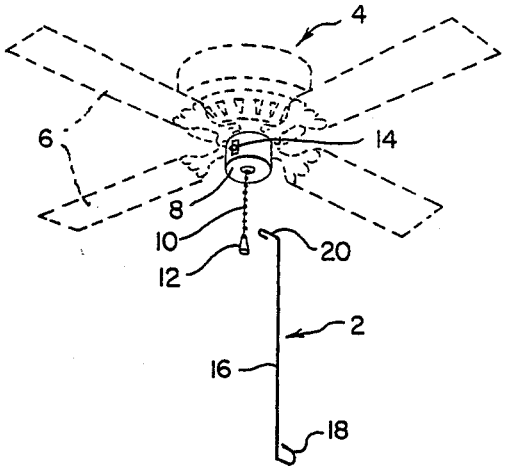
FIG. 1 is a side elevation of an apparatus according to the invention shown adjacent a conventional ceiling fan.

Referring now to the drawings, the fan control wand of the present invention is shown in the various figures, identified generally by the reference numeral 2. The control wand 2 is preferably constructed from a rigid metal wire or rod stock, for example, of a diameter of about ⅛ inch and a length of about 1–3 feet. The wand 2 is shown in FIG. 1 positioned adjacent a conventional ceiling fan 4. The fan includes a plurality of paddle blades 6 which are rotated by a motor within housing 8 positioned beneath the hub thereof. A conventional pull chain 10 extends downwardly from the motor housing and carries an enlarged link or flared element 12 at the end thereof. The pull chain is used to activate and deactivate the fan motor as well as used to change the rotative speed of the motor by pulling in a sequential fashion. For example, in most conventional fans, a first pull of chain 10 activates the motor to run at a first speed; a second pull of the chain incrementally increases the rotative speed of the motor and a third pull incrementally increases the fan speed to a still higher rate. A fourth pull of the chain 10 will deactivate the fan motor.

The pull chain in some fans may also be used to activate or deactivate a lighting fixture attached to the fan 4. My invention is also useful for turning the light on and off by pulling the chain 10 or by pulling a separate light switch chain (not shown). The fan motor housing 8 also has a slide switch button 14 mounted on its sidewall for reciprocal movement in a vertical direction to control the rotative direction of the fan motor.

Figure 2:
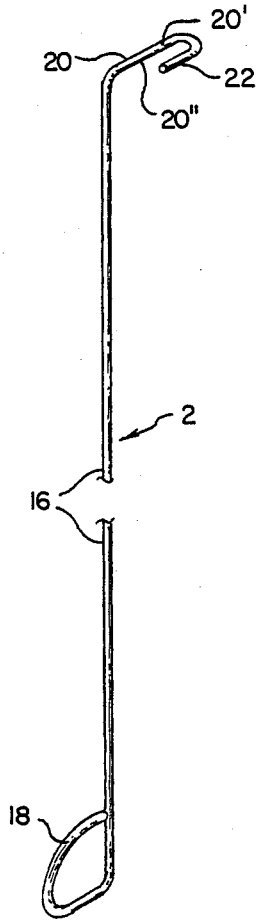
FIG. 2 is an enlarged side elevational view of the apparatus of FIG. 1.

Referring now to FIGS. 1 and 2, the structure of control wand 2 is shown in a simplified form. The control wand includes an elongated rod-shaped body 16 of a rigid metal or plastic material in wire or rod form. The rod-shaped body 16 is constructed in any convenient length of, for example, between 1–3 feet. The elongated body 16 has a loop-shaped handle 18 integrally formed at a first end. Handle 18 is conveniently formed by bending the first end of the body 16 backwardly upon itself to create the desired loop shape from the same material stock as the body. In similar fashion, a right angle bent portion 20 is formed at a second end of the elongated body 16. The terminal end of right angle bent portion 20 is further bent back upon itself to form an open hook-shaped finger element 22. The rod or wire material forming the bent portion 20 and hook-shaped finger element 22 preferably lies in a common plane which is perpendicular to the longitudinal axis of the elongated body 16. The opening defined between the hook finger element 22 and bent portion 20 is formed to be slightly larger than a diameter of the pull chain 10, but smaller than a diameter of the enlarged or flared end link portion 12 thereof. In use, the rod-shaped wand 2 is grasped by the handle 18 and directed toward the fan 4 as shown in FIG. 1. The handle 18 not only provides a convenient means for grasping the wand, but also prevents the body 16 and bent portion 20 from freely turning in the user's hand, as would be the case if the rod-shaped elongated body 16 were grasped alone. The user merely moves the hook-shaped finger portion 22 around the pull chain 10 and then pulls downwardly thereon. The enlarged end portion 12 of the pull chain stops against the hook-shaped element 22 on one side and against bent portion 20 on the other side so that continued downward movement of control wand 2 causes like downward movement of the pull chain to effect the control of the motor speed or to activate or deactivate the motor, depending upon the exact control sequence stage the fan motor is in at that time.

Figure 3:
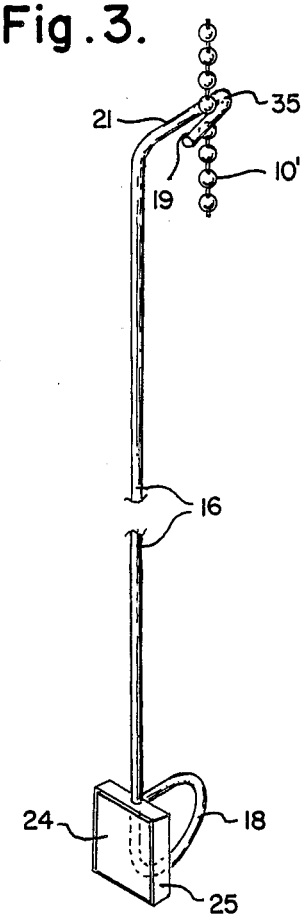
FIG. 3 is a partial fragmented view of one preferred embodiment of a handle portion of the apparatus of the invention, including a V-shaped hook portion at the opposed end thereof.

In a slightly modified form shown in FIG. 3, the chain engaging element may be formed in a V-shaped manner defined by bent portion 21 and portion 19 having a sharp or narrow inside apex at 35. Apex 35 is suitable for engaging the area of the chain between the ball-shaped beads 10' of the pull chain in order to activate the fan motor or lighting element.

Figure 5:
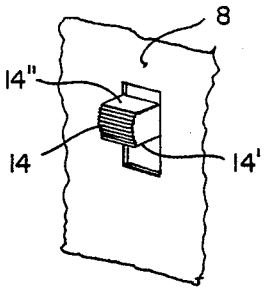
FIG. 5 is an enlarged, fragmented perspective view of the slide switch on the fan housing.

The right angle bent portion 20 at the second end of the elongated body 16 of the control wand 2 also is uniquely shaped to permit convenient manipulation of the slide switch button 14. Referring to FIGS. 1, 2 and 5, an upper edge 20' of the flat, right angle bent portion 20 is adapted to engage a lower face 14' of the switch button 14 to permit the button 14 to be slid upwardly by an upward movement of the control wand 2. Conversely, the switch button is moved downwardly by engaging an upper face 14'' of the switch with a lower edge 20'' of the bent portion 20 and moving the wand in a downward direction.

As shown in FIG. 3, the first end of the elongated rod-shaped body 16 may be fitted with a magnet 24 adjacent to the handle 18. The magnet 24 is adhesively bonded within a metal frame 25 which, in turn, is secured to the handle 18 by welding, for example. In this modified configuration, the control wand 2 may be conveniently affixed to a metal surface, such as the side of a refrigerator, range or other surface for ready use.

It is seen that the handle 18 protrudes outwardly from the reverse flat face of the magnet 24 which provides a convenient orientation for grasping the handle when the wand is affixed to a flat surface.

Figure 4:
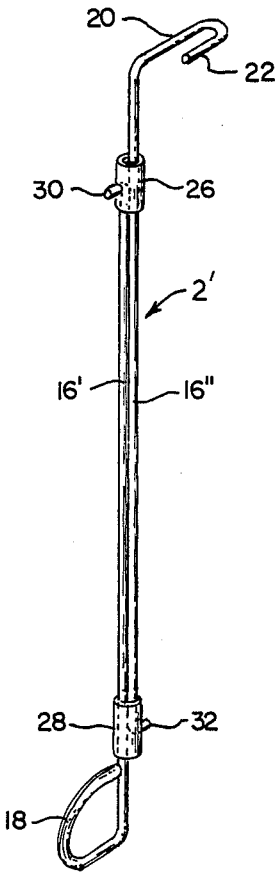
FIG. 4 is a side elevational view of a modified form of the invention having an extensible feature.

A still further embodiment of the present invention is depicted in FIG. 4, wherein control wand 2' is extensible and retractable. A first elongated rod-shaped body 16' has a handle 18 at its first end and a hooked end 30 at its second end. A second elongated rod-shaped body 16'' is slidably positioned adjacent to the first elongated body 16''. Second elongated body includes a hooked end 32 at a first end and a right angle bent portion 20 and a hooked-shaped element 22 at its second end as previously described in the embodiment of FIGS. 1 and 2. A first tubular retainer bushing 26 is fitted around the first and second bodies 16' and 16'' and is fixed to the hooked end 30 of the first body 16' whereby the relative sliding movement between the bushing 26 and body 16' is prevented while relative sliding movement between the bushing 26 and second body 16' is permitted. In similar fashion, a second tubular bushing 28 is attached to hooked end 32 of second elongated rod-shaped body 16'' to permit relative movement of first elongated body 16' while preventing such relative movement with respect to second body 16''. As can be visualized from FIG. 4, the rod-shaped first and second bodies 16' and 16'' slidably move as the bushings 26 and 28 are moved together so as to extend the overall length or reach of the control wand 2' to about twice its original, contracted length. The clearance provided by the bushings 26 and 28 between the bodies 16' and 16'' is tight so as to provide a frictional gripping force between the bushings and bodies so as to lend rigidity in the axial direction to the extended bodies. In this regard, the bushings 26 and 28 are preferably formed from a flexible plastic material such as a nylon polyethylene or like plastic tubing, for example.

Having thus described my invention with the detail and particularity required by the Patent Laws, what is claimed and desired to be protected by Letters Patent is set forth in the following claims.

What is claimed is:

1. A control wand for use in connection with a ceiling fan of the type having a pull chain and having a slide switch button thereon, the control wand comprising a first elongated rod-shaped body having a handle formed at a first end and a hook portion formed at a second end, a second elongated rod-shaped body slidably positioned adjacent said first body and having a hook portion formed at a first end and a right angle bent portion formed at a second end, said bent portion also having a hook-shaped element formed at an end region and adapted to engage the pull chain when in use, said control wand further comprising a first tubular bushing surrounding said first and second elongated rod-shaped bodies and secured to the hook portion at the second end of the first rod-shaped body to permit sliding movement of said second rod-shaped body therethrough and a second tubular bushing surrounding said first and second elongated rod-shaped bodies and secured to the hook portion at the first end of the second elongated body to permit sliding movement of the first elongated body therethrough, whereby, in use, said first and second elongated rod-shaped bodies are extensible and contractable to vary the reach of said control wand.

2. The control wand of claim 1 wherein said right angle bent portion and hook-shaped element at the second end of the second elongated rod-shaped body line in a common plane which is substantially perpendicular to longitudinal axes of said first and second elongated rod-shaped bodies.

3. The control wand of claim 1 including a magnet secured thereto adjacent the handle.

4. The control wand of claim 1 wherein the first and second tubular bushings are constructed of a flexible polymeric material and tightly engage said first and second elongated rod-shaped bodies to provide axial rigidity to said control wand.

5. The control wand of claim 4 wherein the first and second elongated rod-shaped bodies are constructed of metal material.

6. The control wand of claim 5 including a magnet secured thereto adjacent the handle.

* * * * *